United States Patent [19]

Gregg

[11] 4,245,765

[45] Jan. 20, 1981

[54] DISPENSER FOR ABRASIVE DISCS

[75] Inventor: Edward H. Gregg, Woodstock, Conn.

[73] Assignee: Norton Company, Worcester, Mass.

[21] Appl. No.: 73,947

[22] Filed: Sep. 10, 1979

[51] Int. Cl.[3] ..... B26F 3/02

[52] U.S. Cl. ..... 225/13; 225/25; 225/47; 225/48; 225/53

[58] Field of Search ..... 225/13, 25, 48–54, 225/47

[56] References Cited

U.S. PATENT DOCUMENTS

| | | | |
|---|---|---|---|
| 1,027,331 | 5/1912 | Hargis | 225/13 |
| 2,743,009 | 4/1956 | Williamson et al. | 225/48 X |
| 3,098,594 | 7/1963 | Williamson | 225/48 |
| 3,912,142 | 10/1975 | Steinhauser et al. | 225/52 |

*Primary Examiner*—Frank T. Yost

*Attorney, Agent, or Firm*—Rufus M. Franklin

[57] ABSTRACT

A dispenser for a roll of coated abrasive discs having a front face including a cutter bar, a guide means at one side of said cutter bar for positioning a disc edge at the cutter bar, and a recess on the other side of said cutter bar to permit manual access to said roll.

3 Claims, 3 Drawing Figures

DISPENSER FOR ABRASIVE DISCS

FIELD OF THE INVENTION

The invention is a dispenser for individually dispensing abrasive discs from a roll of discs.

BACKGROUND OF THE INVENTION

U.S. Pat. No. 3,912,142 to Steinhauser discloses a dispenser for individually dispensing coated abrasive discs from a roll of such discs. Each disc is joined to the next disc by a narrow unsevered neck portion. In order to register the neck portion with the cutter bar of the dispenser, the front face of the dispenser is provided with a recess at the cutter bar, defined by raised wall portions at each side of the cutter bar, and the ends of the dispenser are open, for manual access to the abrasive rolls to enable the user to reach and pull out the next disc at the end of the roll. The present invention is an improvement over the dispenser disclosed in the Steinhauser patent.

BRIEF SUMMARY OF THE INVENTION

The dispenser of the present invention can be made of corrugated cardboard and serves as the individual shipping container for the coated abrasive roll. The roll is rotatably supported in the container, and the front face of the container includes a centrally located cutter bar. Adjacent one end of the cutter bar the wall of the front face extends above the cutter bar to define a stop means whereby the discs can be engaged with the cutter bar only at the narrow neck between discs. On the side of the cutter bar opposite the stop means is a recess extending below the cutter bar, whereby the user can reach into the container to pull out a new disc. The sides of the box are closed by sidewalls which support the roll for rotation.

A modification of the invention is shown in which the stop means additionally includes a curved surface arranged to conform to the curve a disc at one side of the cutter bar when the disc is in position for separation.

DESCRIPTION OF THE PREFERRED EMBODIMENTS

Figure 1:
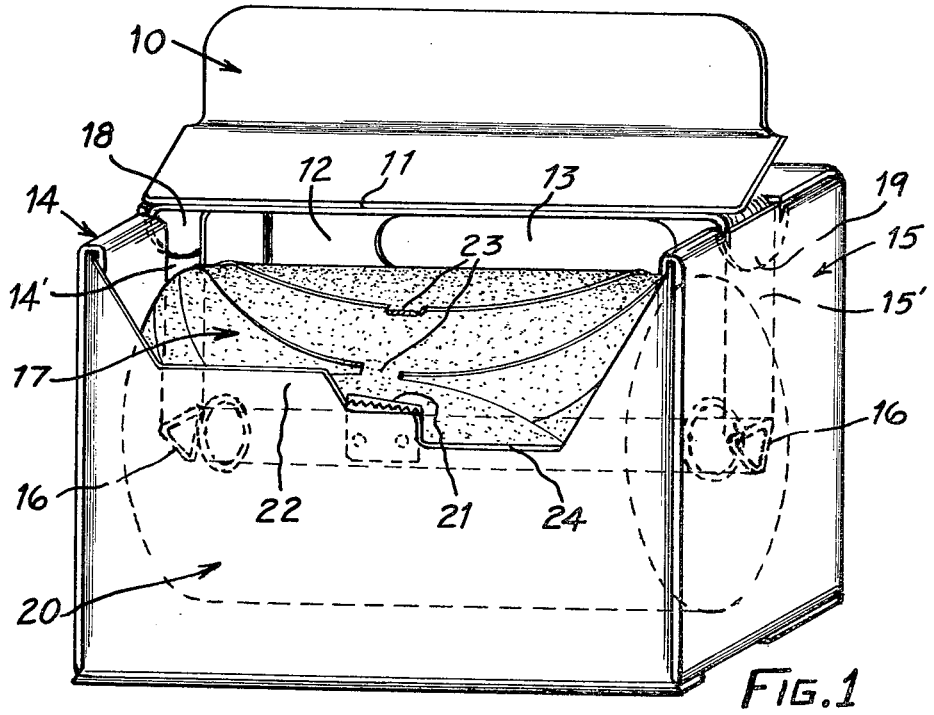
FIG. 1 is a front perspective of the dispenser-container of the invention.

FIG. 1 shows the dispensing container of the present invention, including a roll of coated abrasive discs. The discs may be provided with a pressure sensitive adhesive on the non-abrasive side, for quick attachment to a disc holder.

The dispensing container is provided with a top 10, which may be detached at score line 11 after opening. The back of the container 12 is provided with a knock-out portion 13 to serve as a handle. The side walls 14, 15 are provided with a double thickness whereby the inner portion of the wall is provided with a slot 14', 15' to accommodate and support, at its bottom, the spindle 16 around which the roll 17 of the discs is adapted to rotate.

Tabs 18 and 19 of the top 10 are adapted to fit snugly in the top of slots 14' and 15'.

The front face 20 of the dispenser-container is provided with a cutter-bar 21, and a guide-stop portion 22, at one end thereof. The face has a recess 24 at the other end of the cutter-bar for finger access to reach the next to be removed disc. In operation, the guide-stop wall 2 engages between two discs as the discs are unrolled and stops the unrolling at the proper point, when the narrow portion 23 between two discs is positioned over the cutter bar.

From the above description it can be seen that the dispenser-container described can function as both a shipping package for the coated abrasive roll and as a protective container while it is functioning as a dispenser.

Figure 2:
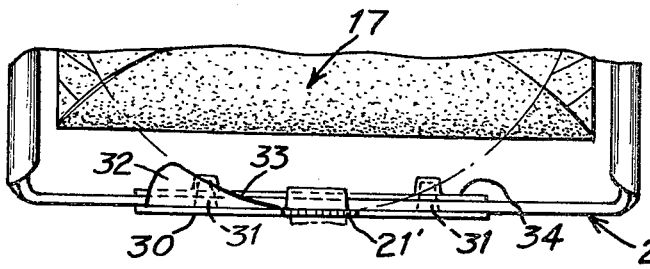
FIG. 2 is a partial top view of a modification of the invention.
Figure 3:
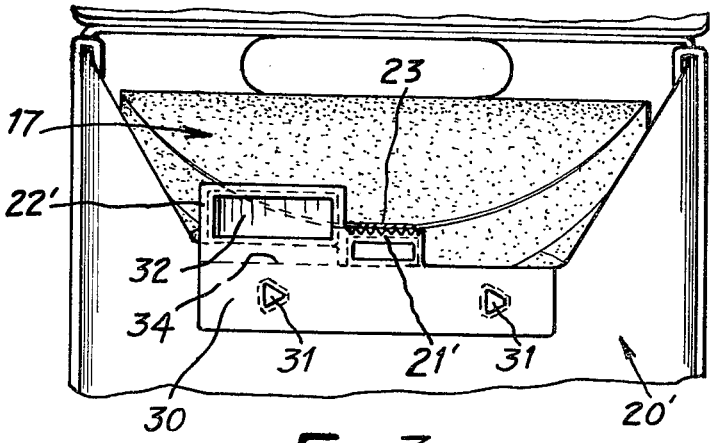
FIG. 3 is a partial front view showing the modified structure of FIG. 2.

FIG. 2 shows a modification of the invention in which the cutter bar and the guide stop means are provided by a plastic attachment 30 pinned to the front face 20' of the dispenser-container by pins 31 and held by fastener plate 34. The guide stop means 22' is supplemented by a pressed-out rearwardly facing projection 32, which provides a stop surface 33 for the curved edge of the disc following the disc to be removed by the cutter bar 21'.

What is claimed is:

1. A dispensing package for coated abrasive disc joined edge to edge in a roll, said container having side walls, a cover, and a front wall, said front wall supporting a cutter bar, means on said front wall projecting above the cutter bar at one end thereof to engage in the space between two discs adjacent their join to thereby align the join with the cutter bar, and a recess extending below the cutter bar at the other end thereof for manual access to the next to be dispensed adjacent disc on the roll, said side walls providing means for rotatably supporting said roll.

2. A dispenser as in claim 1 wherein the cover is displacable for access to said roll.

3. A dispenser container as in claim 1 in which is provided an additional guide means at the end of the cutter bar opposite said recess, said guide means projecting toward said roll from said front wall and comprising a curved surface congruent to the curved edge of a disc.

* * * * *